US010692510B2

(12) United States Patent
Fischer et al.

(10) Patent No.: US 10,692,510 B2
(45) Date of Patent: Jun. 23, 2020

(54) ENCODER AND METHOD FOR ENCODING AN AUDIO SIGNAL WITH REDUCED BACKGROUND NOISE USING LINEAR PREDICTIVE CODING

(71) Applicant: Fraunhofer-Gesellschaft zur Förderung der angewandten Forschung e.V., München (DE)

(72) Inventors: Johannes Fischer, Bammersdorf (DE); Tom Bäckström, Helsinki (FI); Emma Jokinen, Helsinki (FI)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 52 days.

(21) Appl. No.: 15/920,907

(22) Filed: Mar. 14, 2018

(65) Prior Publication Data

US 2018/0204580 A1 Jul. 19, 2018

Related U.S. Application Data

(63) Continuation of application No. PCT/EP2016/072701, filed on Sep. 20, 2016.

(30) Foreign Application Priority Data

Sep. 25, 2015 (EP) ..... 15186901
Jun. 21, 2016 (EP) ..... 16175469

(51) Int. Cl.
*G10L 19/012* (2013.01)
*G10L 21/0208* (2013.01)
(Continued)

(52) U.S. Cl.
CPC ..... *G10L 19/012* (2013.01); *G10L 19/005* (2013.01); *G10L 19/06* (2013.01);
(Continued)

(58) Field of Classification Search
CPC ..... G10L 19/005; G10L 19/04; G10L 19/06; G10L 19/08; G10L 19/09; G10L 19/16;
(Continued)

(56) References Cited

U.S. PATENT DOCUMENTS 5,173,941 A * 12/1992 Yip ..... G10L 19/12 704/217
5,307,460 A * 4/1994 Garten ..... G10L 19/135 704/219

(Continued)

FOREIGN PATENT DOCUMENTS

EP 1944761 A1 7/2008
EP 2608200 B1 8/2014

(Continued)

OTHER PUBLICATIONS

Soundeffects.ch: "Civilisation soundscapes library"; accessed: Sep. 23, 2015; Online Available: https://www.soundeffects.ch/de/geraeusch-archive/soundeffects.ch-_produkte/civilisation-soundscapes-d.php\ (9 pages).

(Continued)

*Primary Examiner* — Eric Yen
(74) *Attorney, Agent, or Firm* — Haynes and Boone, LLP

(57) ABSTRACT

It is shown an encoder for encoding an audio signal with reduced background noise using linear predictive coding. The encoder includes a background noise estimator configured to estimate background noise of the audio signal, a background noise reducer configured to generate background noise reduced audio signal by subtracting the estimated background noise of the audio signal from the audio signal, and a predictor configured to subject the audio signal to linear prediction analysis to obtain a first set of linear prediction filter (LPC) coefficients and to subject the background noise reduced audio signal to linear prediction analysis to obtain a second set of linear prediction filter (Continued)

(LPC) coefficients. Furthermore, the encoder includes an analysis filter composed of a cascade of time-domain filters controlled by the obtained first set of LPC coefficients and the obtained second set of LPC coefficients.

13 Claims, 7 Drawing Sheets

(51) Int. Cl.

| | |
|---|---|
| ***G10L 19/06*** | (2013.01) |
| ***G10L 21/0216*** | (2013.01) |
| ***G10L 21/0224*** | (2013.01) |
| ***G10L 19/08*** | (2013.01) |
| ***G10L 21/0308*** | (2013.01) |
| ***G10L 21/02*** | (2013.01) |
| ***G10L 19/005*** | (2013.01) |
| ***G10L 25/12*** | (2013.01) |
| ***G10L 19/26*** | (2013.01) |
| ***G10L 19/16*** | (2013.01) |
| ***G10L 21/0232*** | (2013.01) |
| ***G10L 19/125*** | (2013.01) |

(52) U.S. Cl.
CPC ..... *G10L 19/08* (2013.01); *G10L 19/16* (2013.01); *G10L 19/265* (2013.01); *G10L 21/0205* (2013.01); *G10L 21/0208* (2013.01); *G10L 21/0216* (2013.01); *G10L 21/0224* (2013.01); *G10L 21/0232* (2013.01); *G10L 21/0308* (2013.01); *G10L 25/12* (2013.01); *G10L 19/125* (2013.01)

(58) Field of Classification Search
CPC ..... G10L 19/26; G10L 19/265; G10L 21/02; G10L 21/0205; G10L 21/0208; G10L 2021/02082; G10L 2021/02085; G10L 2021/02087; G10L 21/0216; G10L 21/0224; G10L 21/0308; G10L 25/12
See application file for complete search history.

(56) References Cited

U.S. PATENT DOCUMENTS

| | | | | |
|---|---|---|---|---|
| 5,550,924 | A * | 8/1996 | Helf | G10L 21/0208 381/94.3 |
| 5,590,242 | A * | 12/1996 | Juang | G10L 15/20 704/222 |
| 5,706,395 | A * | 1/1998 | Arslan | G10L 21/0208 704/226 |
| 6,001,131 | A * | 12/1999 | Raman | G10L 21/0208 704/226 |
| 6,028,890 | A * | 2/2000 | Salami | H04M 11/06 375/216 |
| 6,263,307 | B1 | 7/2001 | Arslan et al. | |
| 6,757,395 | B1 * | 6/2004 | Fang | G10L 21/0208 381/94.3 |
| 7,065,486 | B1 * | 6/2006 | Thyssen | G10L 21/0208 704/215 |
| 8,949,120 | B1 * | 2/2015 | Every | G10L 21/0208 704/226 |
| 2002/0147595 | A1 * | 10/2002 | Baumgarte | G10L 19/02 704/500 |
| 2004/0015349 | A1 * | 1/2004 | Vinton | G10L 19/02 704/230 |
| 2005/0049857 | A1 * | 3/2005 | Seltzer | G10L 15/20 704/226 |
| 2005/0058278 | A1 * | 3/2005 | Gallego Hugas | G10L 21/0208 379/406.01 |
| 2005/0261893 | A1 * | 11/2005 | Toyama | G10L 19/02 704/201 |
| 2006/0222184 | A1 * | 10/2006 | Buck | G10L 21/0208 381/71.1 |
| 2008/0071528 | A1 * | 3/2008 | Ubale | G10L 19/173 704/220 |
| 2008/0097763 | A1 * | 4/2008 | Van De Par | G10L 19/002 704/500 |
| 2013/0246059 | A1 * | 9/2013 | Kechichian | G10L 21/0208 704/226 |
| 2014/0052439 | A1 * | 2/2014 | Rose | G10L 19/09 704/219 |
| 2014/0236587 | A1 * | 8/2014 | Subasingha | G10L 19/12 704/219 |
| 2014/0270226 | A1 * | 9/2014 | Borgstrom | G10L 17/00 381/71.11 |
| 2015/0124987 | A1 * | 5/2015 | Hazrati | H04R 25/453 381/66 |
| 2018/0075859 | A1 * | 3/2018 | Song | G10L 19/06 |

FOREIGN PATENT DOCUMENTS

| | | | |
|---|---|---|---|
| EP | 2676264 | B1 | 1/2015 |
| JP | 2002-175100 | A | 6/2002 |
| JP | 2010-518434 | A | 5/2010 |
| RU | 2483368 | C2 | 5/2013 |
| RU | 2523215 | C2 | 7/2014 |
| WO | WO 2014 202788 | A1 | 12/2014 |

OTHER PUBLICATIONS

3GPP TS 26.071 V9.0.0 (Dec. 2009) "Mandatory speech CODEC speech processing functions; AMR speech Codec; General description"; Online Available: http://www.3gpp.org/ftp/Specs/html-info/26071.htm (12 pages).
3GPP TS 26.190 V7.0.0 (Jun. 2007) Adaptive Multi-Rate (AMR-WB) speech codec, 2007 (53 pages).
3GPP TS 26.190 V9.0.0 (Dec. 2009) "Speech codec speech processing functions; Adaptive Multi-Rate-Wideband (AMR-WB) speech codec; Transcoding functions"; Online Available: http://www.3gpp.org/ftp/Specs/html-info/26190.htm (51 pages).
3GPP TS 26.445 V12.1.0 (Dec. 2014) EVS Codec Detailed Algorithmic Description (Release 12); 2014 (24 pages).
J. Allen: "Short-term spectral analysis, and modification by discrete Fourier transform"; IEEE Trans. Acoust., Speech, Signal Process.; vol. 25; pp. 235-238; 1977 (4 pages).
T. Bäckström: "Computationally efficient objective function for algebraic codebook optimization in ACELP"; Proc. Interspeech; Aug. 2013 (5 pages).
T. Bäckström: "Comparison of windowing in speech and audio coding"; Proc. WASPAA; Oct. 2013 (4 pages).
T. Bäckström et al.: "Decorrelated innovative codebooks for ACELP using factorization of autocorrelation matrix"; Proc. Interspeech; 2014; pp. 2794-2798 (5 pages).
B. Bessette et al.: "The adaptive multirate wideband speech codec (AMR-WB)"; IEEE Transactions on Speech and Audio Processing; vol. 10; No. 8; pp. 620-636; Nov. 2002 (18 pages).
M. Dietz et al.: "Overview of the EVS codec architecture"; IEEE International Conference on Acoustics, Speech and Signal Processing (ICASSP); Apr. 2015; pp. 5698-5702 (5 pages).
Fapi et al.: "Noise Reduction within Network through Modification of LPC Parameters"; 7th International ITG Conference on Source and Channel Coding (SCC); Jan. 14, 2008; pp. 1-6; XP055312348; Retrieved from the Internet: URL:http://ieeexplore.ieee.org/ielx5/5755489/5755490/05755780.pdf?tp=&arnumber=5755780&isnumber=5755490 [retrieved on Oct. 19, 2016] (6 pages).
J. Fischer et al.: "Comparison of windowing schemes for speech coding"; Proc EUSIPCO; 2015 (5 pages).
ISO/IEC 23003-3:2012 "MPEG-D (MPEG audio technologies), Part 3: Unified speech and audio coding"; 2012 (286 pages).
M. Jeub et al.: "Enhancement of reverberant speech using the CELP postfilter"; Proc. ICASSP; Apr. 2009; pp. 3993-3996 (4 pages).
M. Jeub et al.: "Noise reduction for dual-microphone mobile phones exploiting power level differences"; Proc. ICASSP; Mar. 2012; pp. 1693-1696 (4 pages).

(56) References Cited

OTHER PUBLICATIONS

R. Martin et al.: "Optimized estimation of spectral parameters for the coding of noisy speech"; Proc. ICASSP; vol. 3; 2000; pp. 1479-1482 (4 pages).
M. Neuendorf et al.: "Unified speech and audio coding scheme for high quality at low bitrates"; IEEE International Conference on Acoustics, Speech and Signal Processing (ICASSP); Apr. 2009; pp. 1-4 (4 pages).
Recommendation ITU-R BS.1534 "Method for the subjective assessment of intermediate quality levels of coding systems"; 2003; Online Available: http://www.itu.int/rec/R-REC-BS.1534/en. (18 pages).
M. Schroeder et al.: "Code-excited linear prediction (CELP): High-quality speech at very low bit rates"; Proc. ICASSP; IEEE; 1985, pp. 937-940 (4 pages).
S. Srinivasan et al.: "Codebook Driven Short-Term Predictor Parameter Estimation for Speech Enhancement"; IEEE Transactions on Audio, Speech and Language Processing; vol. 14; No. 1; Jan. 2006; pp. 163-176; XP00255173 (14 pages).
H. Taddei et al.: "Noise reduction on speech codec parameters"; Proc. ICASSP; vol. 1; May 2004; pp. I-497-I-500 (4 pages).
P. P. Vaidyanathan: "The theory of linear prediction"; Synthesis Lectures on Signal Processing; vol. 2; pp. 1-184; Morgan & Claypool publishers; 2007 (198 pages).
J. Benesty et al.: "Springer Handbook of Speech Processing"; Springer; 2008 (publication information flyer only).
Office Action in the parallel Russian patent application No. 2018115191 dated Dec. 27, 2018 (12 pages).
Office Action dated Mar. 5, 2019 issued in the parallel JP patent application No. 2018-515646 (6 pages with English translation).

* cited by examiner

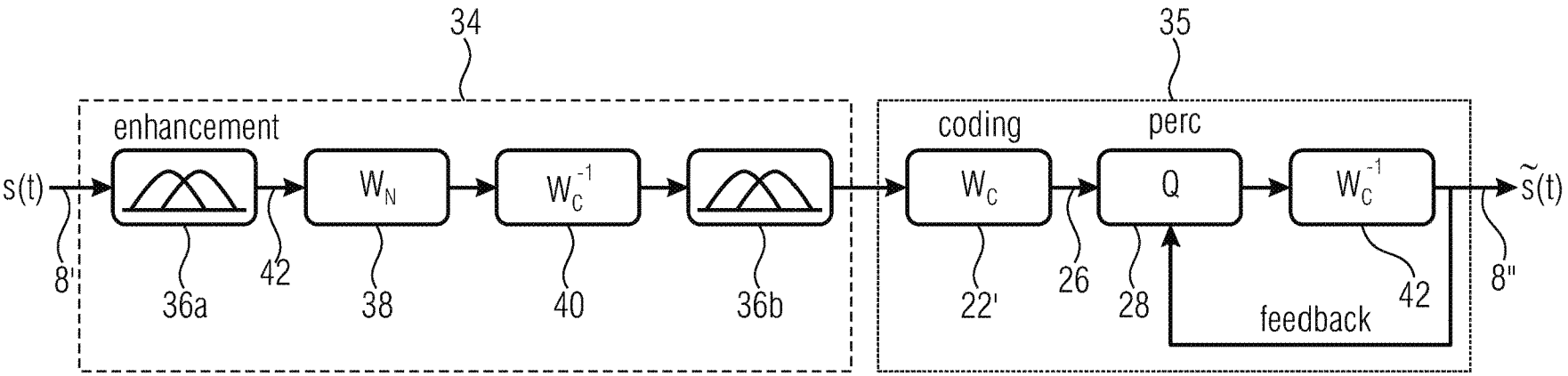
cascaded enhancement and coding
Fig. 2A
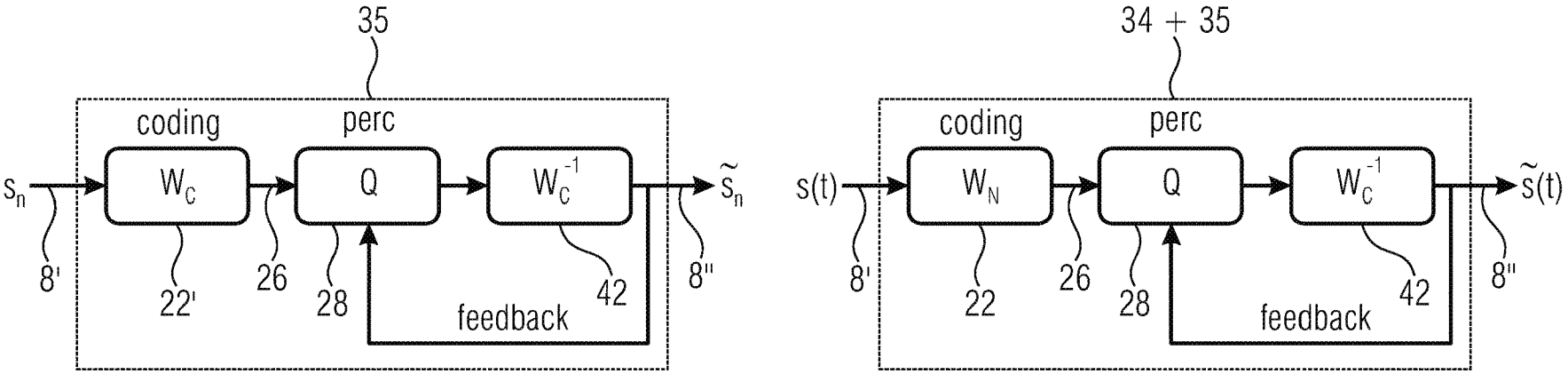
CELP speech coding
Fig. 2B
joint enhancement and coding
Fig. 2C cascaded enhancement and coding joint enhancement and coding CELP speech coding the results for 7.2 kHz the results for 13.2 kHz

ENCODER AND METHOD FOR ENCODING AN AUDIO SIGNAL WITH REDUCED BACKGROUND NOISE USING LINEAR PREDICTIVE CODING

CROSS-REFERENCES TO RELATED APPLICATIONS

This application is a continuation of co-pending International Application No. PCT/EP2016/072701, filed Sep. 20, 2016, which is incorporated herein by reference in its entirety, and additionally claims priority from European Applications Nos. 15186901.3, filed Sep. 25, 2015, and EP 16175469.2, filed Jun. 21, 2016, both of which are incorporated herein by reference in their entirety.

The present invention relates to an encoder for encoding an audio signal with reduced background noise using linear predictive coding, a corresponding method and a system comprising the encoder and a decoder. In other words, the present invention relates to a joint speech enhancement and/or encoding approach, such as for example joint enhancement and coding of speech by incorporating in a CELP (codebook excited linear predictive) codec.

BACKGROUND OF THE INVENTION

As speech and communication devices have become ubiquitous and are likely to be used in adverse conditions, the demand for speech enhancement methods which can cope with adverse environments has increased. Consequently, for example, in mobile phones it is by now common to use noise attenuation methods as a pre-processing block/step for all subsequent speech processing such as speech coding. There exist various approaches which incorporate speech enhancement into speech coders [1, 2, 3, 4]. While such designs do improve transmitted speech quality, cascaded processing does not allow a joint perceptual optimization/minimization of quality, or a joint minimization of quantization noise and interference has at least been difficult.

The goal of speech codecs is to allow transmission of high quality speech with a minimum amount of transmitted data. To reach this goal an efficient representations of the signal is needed, such as modelling of the spectral envelope of the speech signal by linear prediction, the fundamental frequency by a long-time predictor and the remainder with a noise codebook. This representation is the basis of speech codecs using the code excited linear prediction (CELP) paradigm, which is used in major speech coding standards such as Adaptive Multi-Rate (AMR), AMR-Wide-Band (AMR-WB), Unified Speech and Audio Coding (USAC) and Enhanced Voice Service (EVS) [5, 6, 7, 8, 9, 10, 11].

For natural speech communication, speakers often use devices in hands-free modes. In such scenarios the microphone is usually far from the mouth, whereby the speech signal can easily become distorted by interferences such as reverberation or background noise. The degradation does not only affect the perceived speech quality, but also the intelligibility of the speech signal and can therefore severely impede the naturalness of the conversation. To improve the communication experience, it is then beneficial to apply speech enhancement methods to attenuate noise and reduce the effects of reverberation. The field of speech enhancement is mature and plenty of methods are readily available [12]. However, a majority of existing algorithms are based on overlap-add methods, such as transforms like the short-time Fourier transform (STFT), that apply overlap-add based windowing schemes, whereas in contrast, CELP codecs model the signal with a linear predictor/linear predictive filter and apply windowing only on the residual. Such fundamental differences make it difficult to merge enhancement and coding methods. Yet it is clear that joint optimization of enhancement and coding can potentially improve quality, reduce delay and computational complexity.

Therefore, there is a need for an improved approach.

SUMMARY

According to an embodiment, an encoder for encoding an audio signal with reduced background noise using linear predictive coding may have: a background noise estimator configured to estimate a representation of background noise of the audio signal; a background noise reducer configured to generate a representation of a background noise reduced audio signal by subtracting the representation of the estimated background noise of the audio signal from a representation of the audio signal; a predictor configured to subject the representation of the audio signal to linear prediction analysis to obtain a first set of linear prediction filter (LPC) coefficients and to subject the representation of the background noise reduced audio signal to linear prediction analysis to obtain a second set of linear prediction filter (LPC) coefficients; and an analysis filter composed of a cascade of time-domain filters controlled by the obtained first set of LPC coefficients and the obtained second set of LPC coefficients to obtain a residual signal from the audio signal.

According to another embodiment, a system may have: the encoder for encoding an audio signal with reduced background noise using linear predictive coding, which encoder may have: a background noise estimator configured to estimate a representation of background noise of the audio signal; a background noise reducer configured to generate a representation of a background noise reduced audio signal by subtracting the representation of the estimated background noise of the audio signal from a representation of the audio signal; a predictor configured to subject the representation of the audio signal to linear prediction analysis to obtain a first set of linear prediction filter (LPC) coefficients and to subject the representation of the background noise reduced audio signal to linear prediction analysis to obtain a second set of linear prediction filter (LPC) coefficients; and an analysis filter composed of a cascade of time-domain filters controlled by the obtained first set of LPC coefficients and the obtained second set of LPC coefficients to obtain a residual signal from the audio signal; a decoder configured to decode the encoded audio signal.

According to another embodiment, a method for encoding an audio signal with reduced background noise using linear predictive coding may have the steps of: estimating a representation of background noise of the audio signal; generating a representation of a background noise reduced audio signal by subtracting the representation of the estimated background noise of the audio signal from a representation of the audio signal; subjecting the representation of the audio signal to linear prediction analysis to obtain a first set of linear prediction filter (LPC) coefficients and subjecting the representation of the background noise reduced audio signal to linear prediction analysis to obtain a second set of linear prediction filter (LPC) coefficients; and controlling a cascade of time domain filters by the obtained first set of LPC coefficients and the obtained second set of LPC coefficients to obtain a residual signal from the audio signal.

According to another embodiment, a non-transitory digital storage medium may have a computer program stored thereon to perform the method for encoding an audio signal with reduced background noise using linear predictive coding, which method may have the steps of: estimating a representation of background noise of the audio signal; generating a representation of a background noise reduced audio signal by subtracting the representation of the estimated background noise of the audio signal from a representation of the audio signal; subjecting the representation of the audio signal to linear prediction analysis to obtain a first set of linear prediction filter (LPC) coefficients and subjecting the representation of the background noise reduced audio signal to linear prediction analysis to obtain a second set of linear prediction filter (LPC) coefficients; and controlling a cascade of time domain filters by the obtained first set of LPC coefficients and the obtained second set of LPC coefficients to obtain a residual signal from the audio signal, when said computer program is run by a computer.

Embodiments of the present invention show an encoder for encoding an audio signal with reduced background noise using linear predictive coding. The encoder comprises a background noise estimator configured to estimate background noise of the audio signal, a background noise reducer configured to generate background noise reduced audio signal by subtracting the estimated background noise of the audio signal from the audio signal, and a predictor configured to subject the audio signal to linear prediction analysis to obtain a first set of linear prediction filter (LPC) coefficients and to subject the background noise reduced audio signal to linear prediction analysis to obtain a second set of linear prediction filter (LPC) coefficients. Furthermore, the encoder comprises an analysis filter composed of a cascade of time-domain filters controlled by the obtained first set of LPC coefficients and the obtained second set of LPC coefficients.

The present invention is based on the finding that an improved analysis filter in a linear predictive coding environment increases the signal processing properties of the encoder. More specifically, using a cascade or a series of serially connected time domain filters improves the processing speed or the processing time of the input audio signal if said filters are applied to an analysis filter of the linear predictive coding environment. This is advantageous since the typically used time-frequency conversion and the inverse frequency-time conversion of the inbound time domain audio signal to reduce background noise by filtering frequency bands which are dominated by noise is omitted. In other words, by performing the background noise reduction or cancelation as a part of the analysis filter, the background noise reduction may be performed in the time domain. Thus, the overlap-and-add procedure of for example a MDCT/IDMCT ([inverse] modified discrete cosine transform), which may be used for time/frequency/time conversion, is omitted. This overlap-and-add method limits the real time processing characteristic of the encoder, since the background noise reduction cannot be performed on a single frame, but only on consecutive frames.

In other words, the described encoder is able to perform the background noise reduction and therefore the whole processing of the analysis filter on a single audio frame, and thus enables real time processing of an audio signal. Real time processing may refer to a processing of the audio signal without a noticeable delay for participating users. A noticeable delay may occur for example in a teleconference if one user has to wait for a response of the other user due to a processing delay of the audio signal. This maximum allowed delay may be less than 1 second, advantageously below 0.75 seconds or even more advantageously below 0.25 seconds. It has to be noted that these processing times refer to the entire processing of the audio signal from the sender to the receiver and thus include, besides the signal processing of the encoder also the time of transmitting the audio signal and the signal processing in the corresponding decoder.

According to embodiments, the cascade of time domain filters, and therefore the analysis filter, comprises two times a linear prediction filter using the obtained first set of LPC coefficients and one time an inverse of a further linear prediction filter using the obtained second set of LPC coefficients. This signal processing may be referred to as Wiener filtering. Thus, in other words, the cascade of time domain filters may comprise a Wiener filter.

According to further embodiments, the background noise estimator may estimate an autocorrelation of the background noise as a representation of the background noise of the audio signal. Furthermore, the background noise reducer may generate the representation of the background noise reduced audio signal by subtracting the autocorrelation of the background noise from an estimated autocorrelation of the audio signal, wherein the estimated audio correlation of the audio signal is the representation of the audio signal and wherein the representation of the background noise reduced audio signal is an autocorrelation of the background noise reduced audio signal. Using the estimation of autocorrelation functions instead of using the time domain audio signal for calculating the LPC coefficients and to perform the background noise reduction enables a signal processing completely in the time domain. Therefore, the autocorrelation of the audio signal and the autocorrelation of the background noise may be calculated by convolving or by using a convolution integral of an audio frame or a subpart of the audio frame. Thus, the autocorrelation of the background noise may be performed in a frame or even only in a subframe, which may be defined as the frame or the part of the frame where (almost) no foreground audio signal such as speech is present. Furthermore, the autocorrelation of the background noise reduced audio signal may be calculated by subtracting the autocorrelation of background noise and the autocorrelation of the audio signal (comprising background noise). Using the autocorrelation of the background noise reduced audio signal and the audio signal (typically having background noise) enables calculating the LPC coefficients for the background noise reduced audio signal and the audio signal, respectively. The background noise reduced LPC coefficients may be referred to as the second set of LPC coefficients, wherein the LPC coefficients of the audio signal may be referred to as the first set of LPC coefficients. Therefore, the audio signal may be completely processed in the time domain, since the application of the cascade of time domain filters also perform their filtering on the audio signal in time domain.

Before embodiments are described in detail using the accompanying figures, it is to be pointed out that the same or functionally equal elements are given the same reference numbers in the figures and that a repeated description for elements provided with the same reference numbers is omitted. Hence, descriptions provided for elements having the same reference numbers are mutually exchangeable.

BRIEF DESCRIPTION OF THE DRAWINGS

Embodiments of the present invention will be detailed subsequently referring to the appended drawings, in which:

FIG. 2A shows a schematic block diagram of a cascaded enhancement encoding scheme, FIG. 2B shows a schematic block diagram of a CELP speech coding scheme;

FIG. 2C shows a schematic block diagram of the inventive joint enhancement encoding scheme;

DETAILED DESCRIPTION OF THE INVENTION

In the following, embodiments of the invention will be described in further detail. Elements shown in the respective figures having the same or a similar functionality with have associated therewith the same reference signs.

Following will describe a method for joint enhancement and coding, based on Wiener filtering [12] and CELP coding. The advantages of this fusion are that 1) inclusion of Wiener filtering in the processing chain does not increase the low algorithmic delay of the CELP codec, and that 2) the joint optimization simultaneously minimizes distortion due to quantization and background noise. Moreover, the computational complexity of the joint scheme is lower than the one of the cascaded approach. The implementation relies on recent work on residual-windowing in CELP-style codecs [13, 14, 15], which allows to incorporate the Wiener filtering into the filters of the CELP codec in a new way. With this approach it can demonstrated that both the objective and subjective quality is improved in comparison to a cascaded system.

The proposed method for joint enhancement and coding of speech, thereby avoids accumulation of errors due to cascaded processing and further improving perceptual output quality. In other words, the proposed method avoids accumulation of errors due to cascaded processing, as a joint minimization of interference and quantization distortion is realized by an optimal Wiener filtering in a perceptual domain.

Figure 1:
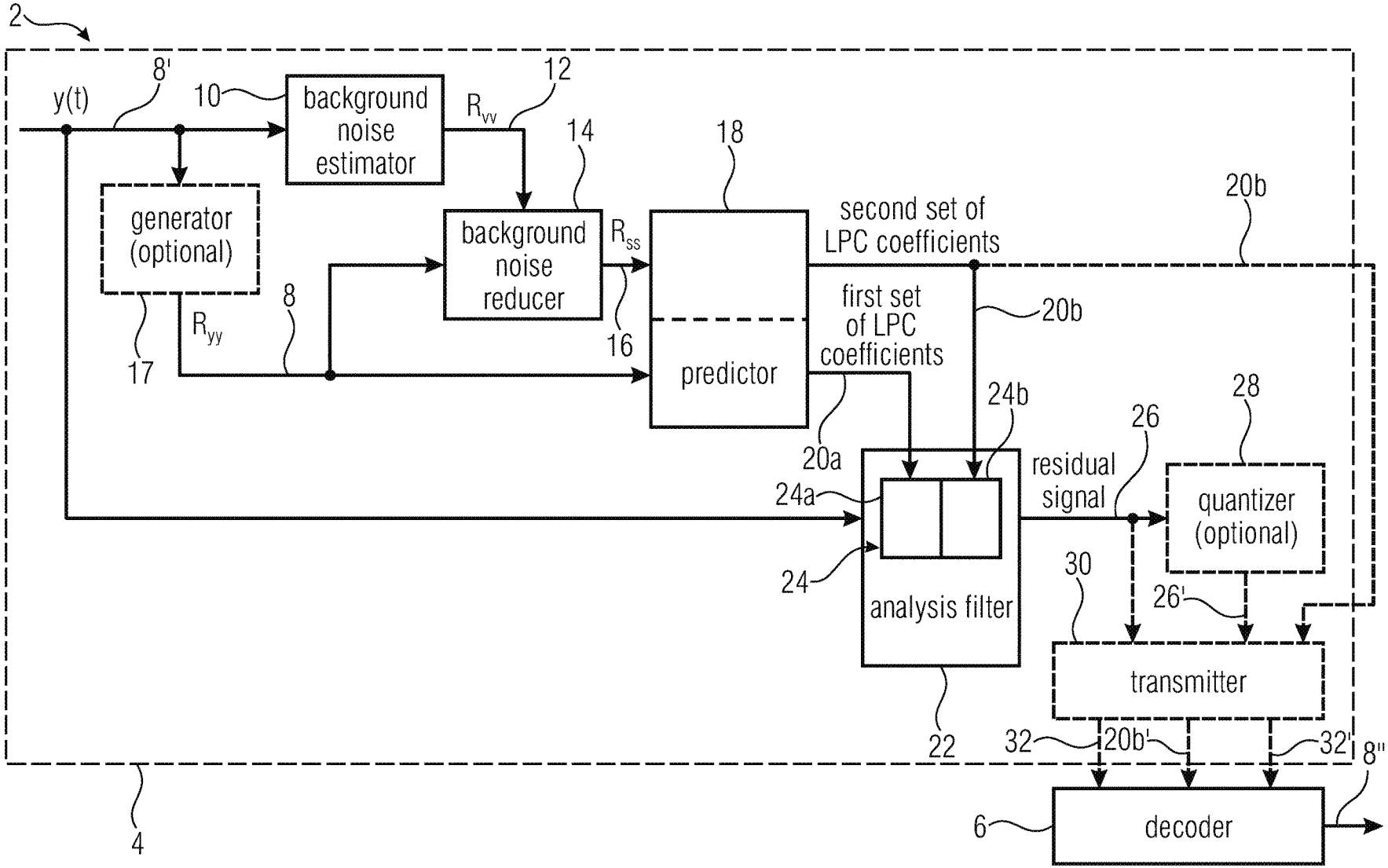
FIG. 1 shows a schematic block diagram of a system comprising the encoder for encoding an audio signal and a decoder.

FIG. 1 shows a schematic block diagram of a system 2 comprising an encoder 4 and a decoder 6. The encoder 4 is configured for encoding an audio signal 8' with reduced background noise using linear predictive coding. Therefore, the encoder 4 may comprise a background noise estimator 10 configured to estimate a representation of background noise 12 of the audio signal 8'. The encoder may further comprise a background noise reducer 14 configured to generate a representation of a background noise reduced audio signal 16 by subtracting the representation of the estimated background noise 12 of the audio signal 8' from a representation of the audio signal 8. Therefore, the background noise reducer 14 may receive the representation of background noise 12 from the background noise estimator 10. A further input of the background noise reducer may be the audio signal 8' or the representation of the audio signal 8. Optionally, the background noise reducer and may comprise a generator configured to internally generate the representation of the audio signal 8, such as for example an autocorrelation 8 of the audio signal 8'.

Furthermore, the encoder 4 may comprise a predictor 18 configured to subject the representation of the audio signal 8 to linear prediction analysis to obtain a first set of linear prediction filter (LPC) coefficients 20*a* and to subject the representation of the background noise reduced audio signal 16 to linear prediction analysis to obtain a second set of linear prediction filter coefficients 20*b*. Similar to the background noise reducer 14, the predictor 18 may comprise a generator to internally generate the representation of the audio signal 8 from the audio signal 8'. However, it may be advantageous to use a common or central generator 17 to calculate the representation 8 of the audio signal 8' once and to provide the representation of the audio signal, such as the autocorrelation of the audio signal 8', to the background noise reducer 14 and the predictor 18. Thus, the predictor may receive the representation of the audio signal 8 and the representation of the background noise reduced audio signal 16, for example the autocorrelation of the audio signal and the autocorrelation of the background noise reduced audio signal, respectively, and to determine, based on the inbound signals, the first set of LPC coefficients and the second set of LPC coefficients, respectively.

In other words, the first set of LPC coefficients may be determined from the representation of the audio signal 8 and the second set of LPC coefficients may be determined from the representation of the background noise reduced audio signal 16. The predictor may perform the Levinson-Durbin algorithm to calculate the first and the second set of LPC coefficients from the respective autocorrelation.

Furthermore, the encoder comprises an analysis filter 22 composed of a cascade 24 of time domain filters 24*a*, 24*b* controlled by the obtained first set of LPC coefficients 20*a* and the obtained second set of LPC coefficients 20*b*. The analysis filter may apply the cascade of time domain filters, wherein filter coefficients of the first time domain filter 24*a* are the first set of LPC coefficients and filter coefficients of the second time domain filter 24*b* are the second set of LPC coefficients, to the audio signal 8' to determine a residual signal 26. The residual signal may comprise the signal components of the audio signal 8' which may not be represented by a linear filter having the first and/or the second set of LPC coefficients.

According to embodiments, the residual signal may be provided to a quantizer 28 configured to quantize and/or encode the residual signal and/or the second set of LPC coefficients 24*b* before transmission. The quantizer may for example perform transform coded excitation (TCX), code excited linear prediction (CELP), or a lossless encoding such as for example entropy coding.

According to a further embodiment, the encoding of the residual signal may be performed in a transmitter 30 as an alternative to the encoding in the quantizer 28. Thus, the transmitter for example performs transform coded excitation (TCX), code excited linear prediction (CELP), or a lossless encoding such as for example entropy coding to encode the residual signal. Furthermore, the transmitter may be configured to transmit the second set of LPC coefficients. An optional receiver is the decoder 6. Therefore, the transmitter 30 may receive the residual signal 26 or the quantized residual signal 26'. According to an embodiment, the transmitter may encode the residual signal or the quantized residual signal, at least if the quantized residual signal is not already encoded in the quantizer. After optional encoding the residual signal or alternatively the quantized residual signal, the respective signal provided to the transmitter is transmitted as an encoded residual signal 32 or as an encoded and quantized residual signal 32'. Furthermore, the transmitter may receive the second set of LPC coefficients 20*b'*, optionally encode the same, for example with the same encoding method as used to encode the residual signal, and further transmit the encoded second set of LPC coefficients 20*b'*, for example to the decoder 6, without transmitting the first set of LPC coefficients. In other words, the first set of LPC coefficients 20*a* does not need to be transmitted.

The decoder 6 may further receive the encoded residual signal 32 or alternatively the encoded quantized residual signal 32' and additionally to one of the residual signals 32 or 32' the encoded second set of LPC coefficients 20*b'*. The decoder may decode the single received signals and provide the decoded residual signal 26 to a synthesis filter. The synthesis filter may be the inverse of a linear predictive FIR (finite impulse response) filter having the second set of LPC coefficients as filter coefficients. In other words, a filter having the second set of LPC coefficients is inverted to form the synthesis filter of the decoder 6. Output of the synthesis filter and therefore output of the decoder is the decoded audio signal 8".

According to embodiments, the background noise estimator may estimate an autocorrelation 12 of the background noise of the audio signal as a representation of the background noise of the audio signal. Furthermore, the background noise reducer may generate the representation of the background noise reduced audio signal 16 by subtracting the autocorrelation of the background noise 12 from an autocorrelation of the audio signal 8, wherein the estimated autocorrelation 8 of the audio signal is the representation of the audio signal and wherein the representation of the background noise reduced audio signal 16 is an autocorrelation of the background noise reduced audio signal.

Figure 3A:
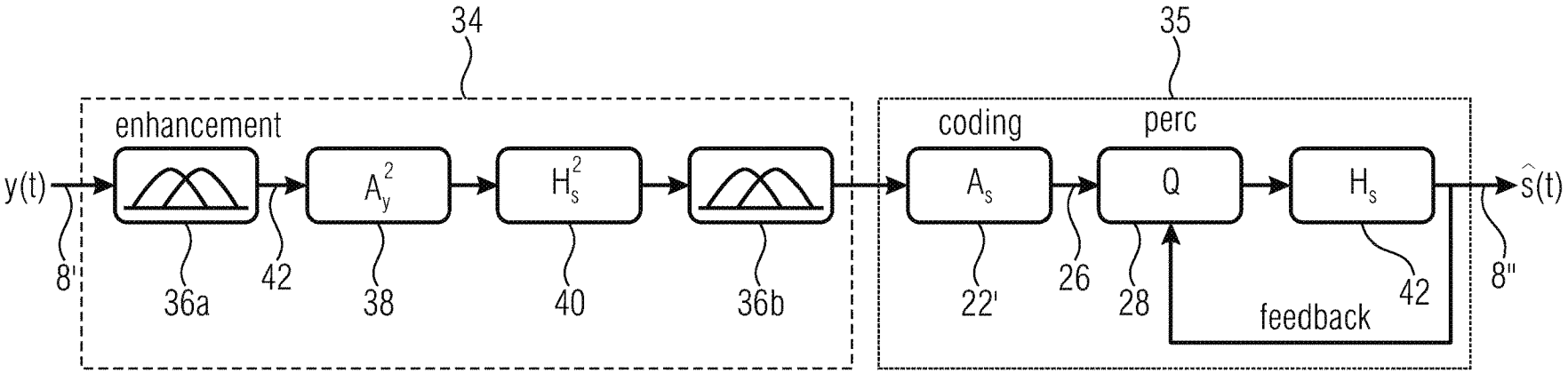
FIG. 3A shows a schematic block diagram of the embodiment of FIG. 2A with a different notation.
Figure 3C:
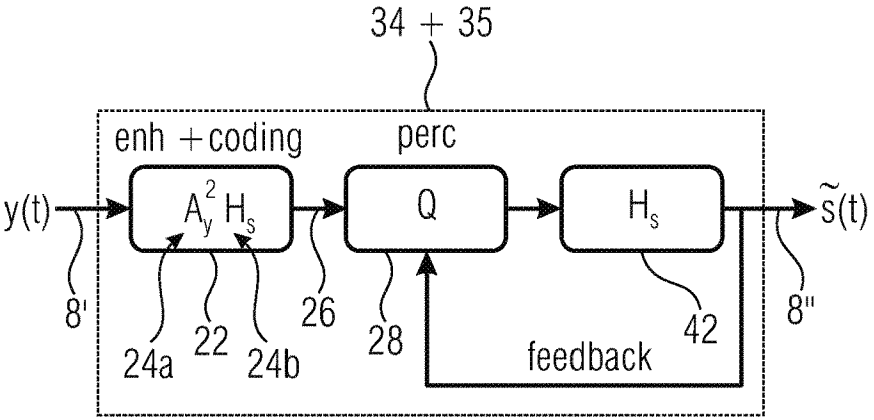
FIG. 3C shows a schematic block diagram of the embodiment of FIG. 2C with a different notation.
Figure 3B:
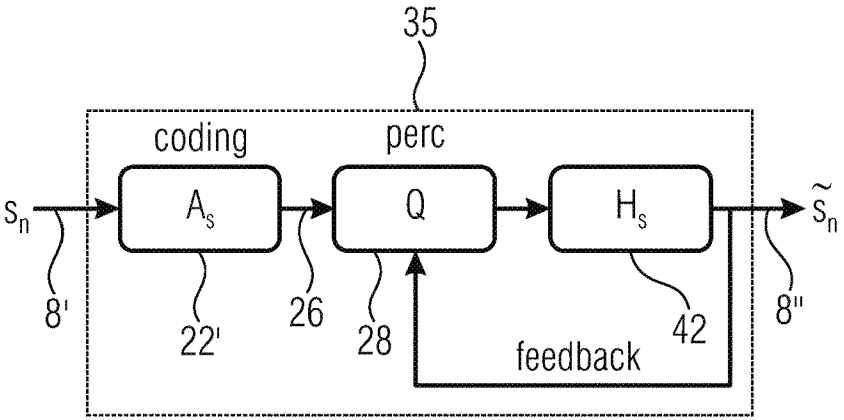
FIG. 3B shows a schematic block diagram of the embodiment of FIG. 2B with a different notation.
Figure 4:
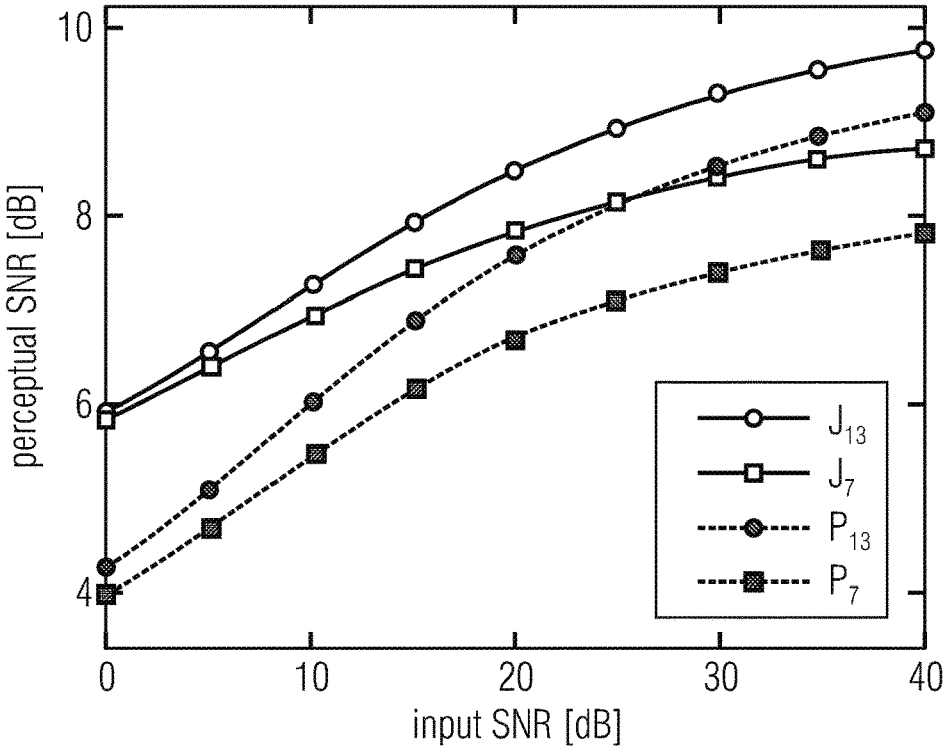
FIG. 4 shows a schematic line chart of the perceptual magnitude SNR (signal-to-noise ratio), as defined in equation 23 for the proposed joint approach (J) and the cascaded method (C), wherein the input signal was degraded by non-stationary car noise, and the results are presented for two different bitrates (7.2 kbit/s indicated by subscript 7 and 13.2 kbit/s indicated by subscript 13)
Figure 5:
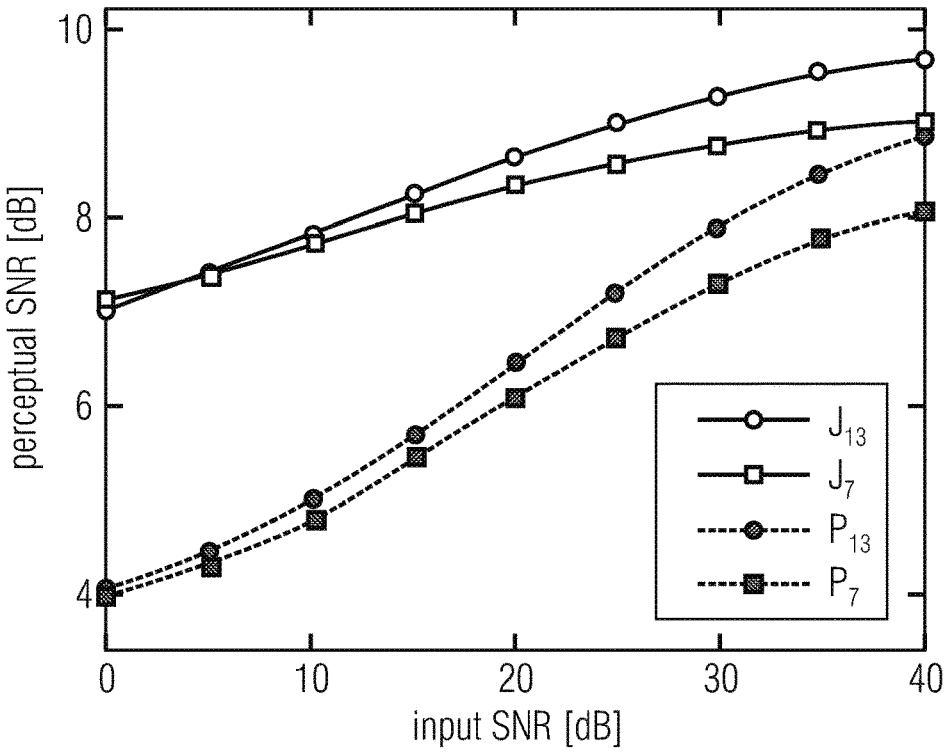
FIG. 5 shows a schematic line chart of the perceptual magnitude SNR, as defined in equation 23 for the proposed joint approach (J) and the cascaded method (C), wherein the input signal was degraded by a stationary white noise, and the results are presented for two different bitrates (7.2 kbit/s indicated by subscript 7 and 13.2 kbit/s indicated by subscript 13)

FIG. 2A-C and FIG. 3A-C both relate to the same embodiment, however using a different notation. Thus, FIG. 2A-C shows illustrations of the cascaded and the joint enhancement/coding approaches where $W_N$ and $W_C$ represent the whitening of the noisy and clean signals, respectively, and $W_N^{-1}$ and $W_C^{-1}$ their corresponding inverses. However, FIG. 3A-C shows illustrations of the cascaded and the joint enhancement/coding approaches where $A_y$ and $A_s$ represent the whitening filters of the noisy and clean signals, respectively, and $H_y$ and $H_s$ are reconstruction (or synthesis) filters, their corresponding inverses.

Both FIG. 2A and FIG. 3A show an enhancement part and a coding part of the signal processing chain thus performing a cascaded enhancement and encoding. The enhancement part 34 may operate in the frequency domain, wherein blocks 36*a* and 36*b* may perform a time frequency conversion using for example an MDCT and a frequency time conversion using for example an IMDCT or any other suitable transform to perform the time frequency and frequency time conversion. Filters 38 and 40 may perform a background noise reduction of the frequency transformed audio signal 42. Herein, those frequency parts of the background noise may be filtered by reducing their impact on the frequency spectrum of the audio signal 8'. Frequency time converter 36*b* may therefore perform the inverse transform from frequency domain into time domain. After background noise reduction was performed in the enhancement part 34, the coding part 35 may perform the encoding of the audio signal with reduced background noise. Therefore, analysis filter 22' calculates a residual signal 26" using appropriate LPC coefficients. The residual signal may be quantized and provided to the synthesis filter 44, which is in case of FIG. 2A and FIG. 3A the inverse of the analysis filter 22'. Since the synthesis filter 42 is the inverse of the analysis filter 22', in case of FIG. 2A and FIG. 3A, the LPC coefficients used to determine the residual signal 26 are transmitted to the decoder to determine the decoded audio signal 8".

FIG. 2B and FIG. 3B show the coding stage 35 without the previously performed background noise reduction. Since the coding stage 35 is already described with respect to FIG. 2A and FIG. 3A, a further description is omitted to avoid merely repeating the description.

FIG. 2C and FIG. 3C relate to the main concept of joint enhancement encoding. It is shown that the analysis filter 22 comprises a cascade of time domain filters using filters $A_y$ and $H_s$. More precisely, the cascade of time domain filters comprises two-times a linear prediction filter using the obtained first set of LPC coefficients 20*a* ($A_y^2$) and one-time an inverse of a further linear prediction filter using the obtained second set of LPC coefficients 20*b* ($H_s$). This arrangement of filters or this filter structure may be referred to as a Wiener filter. However, is has to be noted that one prediction filter $H_s$ cancels out with the analysis filter $A_s$. In other words, it may be also applied twice the filter $A_y$ (denoted by $A_y^2$), twice the filter $H_s$ (denoted by $H_s^2$) and once the filter $A_s$.

As already described with respect to FIG. 1, the LPC coefficients for these filters were determined for example using autocorrelation. Since the autocorrelation may be performed in the time domain, no time-frequency conversion has to be performed to implement the joint enhancement and encoding. Furthermore, this approach is advantageous since the further processing chain of quantization transmitting a synthesis filtering remains the same when compared to the coding stage 35 described with respect to FIGS. 2A and 3A. However, it has to be noted that the LPC filter coefficients based on the background noise reduced signal should be transmitted to the decoder for proper synthesis filtering. However, according to a further embodiment, instead of transmitting the LPC coefficients, the already calculated filter coefficients of the filter 24*b* (represented by the inverse of the filter coefficients 20*b*) may be transmitted to avoid a further inversion of the linear filter having the LPC coefficients to derive the synthesis filter 42, since this inversion has already been performed in the encoder. In other words, instead of transmitting the filter coefficients 20*b*, the matrix-inverse of these filter coefficients may be transmitted, thus avoiding to perform the inversion twice. Furthermore, it has to be noted that the encoder side filter 24*b* and the synthesis filter 42 may be the same filter, applied in the encoder and decoder respectively.

In other words with respect to FIG. 2A-C, speech codecs based on the CELP model are based on a speech production model which assumes that the correlation of the input speech signal $s_n$ can be modelled by a linear prediction filter with coefficients $a=[\alpha_0, \alpha_1, \ldots, \alpha_M]^T$ where M is the model order [16]. The residual $r_n=a_n*s_n$, which is the part of the speech signal that cannot be predicted by the linear prediction filter is then quantized using vector quantization.

Let $s_k=[s_k, s_{k-1}, \ldots, s_{k-M}]^T$ be a vector of the input signal where the superscript $^T$ denotes the transpose. The residual can then be expressed as $$r_k=a^T s_k. \tag{1}$$

Given the autocorrelation matrix $R_{ss}$ of the speech signal vector $s_k$ $$R_{ss}=E\{s_k s_k^T\}, \tag{2}$$

an estimate of the prediction filter of order M can be given as [20]

$$a=\sigma_e^2 R_{ss}^{-1} u, \tag{3}$$

where $u=[1, 0, 0, \ldots, 0]^T$ and the scalar prediction error $\sigma_e^2$ is chosen such that $\alpha_0=1$. Observe that the linear predictive filter $\alpha_n$, is a whitening filter, whereby $r_k$ is uncorrelated white noise. Moreover, the original signal $s_n$ can be reconstructed from the residual $r_n$ through IIR filtering with the predictor $\alpha_n$. The next step is to quantize vectors of the residual $r_k=[r_{kN}, r_{kN-1}, \ldots, r_{kN-N+1}]^T$ with a vector quantizer to $\tilde{r}_k$, such that perceptual distortion is minimized. Let a vector of the output signal be $s_k'=[s_{kN}, s_{kN-1}, \ldots, s_{k-N+1}]^T$ and $\tilde{s}_k'$ its quantized counterpart, and W a convolution matrix which applies perceptual weighting on the output. The perceptual optimization problem can then be written as $$\min_{r_k} \| W(s_k' - \tilde{s}_k') \|^2 = \min_{r_k} \| WH(r_k - \tilde{r}_k) \|^2, \tag{4}$$

where H is a convolution matrix corresponding to the impulse response of the predictor $\alpha_n$.

The process of CELP type speech coding is depicted in FIG. 2B. The input signal is first whitened with the filter $A(z)=\Sigma_{m=0}^{M}\alpha_m z^{-m}$ to obtain the residual signal. Vectors of the residual are then quantized in the block Q. Finally, the spectral envelope structure is then reconstructed by IIR-filtering, $A^{-1}(z)$ to obtain the quantized output signal $\tilde{s}_k$. Since the re-synthesized signal is evaluated in the perceptual domain, this approach is known as the analysis by-synthesis method.

Wiener Filtering

In single channel speech enhancement, it is assume that the signal $y_n$ is acquired, which is an additive mixture of the desired clean speech signal $s_n$ and some undesired interference $v_n$, that is $$y_n=s_n+v_n. \tag{5}$$

The goal of the enhancement process is to estimate the clean speech signal $s_n$, while accessible is only to the noisy signal $y_n$ and estimates of the correlation matrices $$R_{ss}=E\{s_k s_k^T\} \text{ and } R_{yy}=E\{y_k y_k^T\} \tag{6}$$

Where $y_k=[y_k, y_{k-1}, \ldots, y_{k-M}]^T$. Using a filter matrix H, the estimate of the clean speech signal $\hat{s}_n$ is defined as $$\hat{s}_k=Hy_k. \tag{7}$$

The optimal filter in the minimum mean square error (MMSE) sense, known as the Wiener filter can be readily derived as [12]

$$H=R_{ss}R_{yy}^{-1}. \tag{8}$$

Usually, Wiener filtering is applied onto overlapping windows of the input signal and reconstructed using the overlap-add method [21, 12]. This approach is illustrated in Enhancement-block of FIG. 2A. It however leads to an increase in algorithmic delay, corresponding to the length of the overlap between windows. To avoid such delay, an objective is to merge Wiener filtering with a method based on linear prediction.

To obtain such a connection, the estimated speech signal $\hat{s}_k$ is substituted into Eq. 1, whereby $$r_k=a^T\hat{s}_k=a^T H y_k=\sigma_e^2 u^T R_{ss}^{-1} R_{ss} R_{yy}^{-1} y_k=\sigma_e^2 u^T R_{yy}^{-1} y_k=\gamma a'^T y_k \tag{9}$$

where γ is a scaling coefficient and $$a'=\hat{\sigma}_e^2 R_{yy}^{-1} u \tag{10}$$

is the optimal predictor for the noisy signal $y_n$. In other words, by filtering the noisy signal with a' the (scaled) residual of the estimated clean signal is obtained. The scaling is ratio between the ratio between the expected residual errors of the clean and noisy signals, $\sigma_e^2$ and $\hat{\sigma}_e^2$, respectively, that is, $\gamma=\sigma_e^2/\hat{\sigma}_e^2$. This derivation thus shows that Wiener filtering and linear prediction are intimately related methods and in the following section, this connection will be used to develop a joint enhancement and coding method.

Incorporating Wiener Filtering into a CELP Codec

An objective is to merge Wiener filtering and a CELP codecs (described in section 3 and section 2) into a joint algorithm. By merging these algorithms the delay of overlap-add windowing which may be used by usual implementations of Wiener filtering can be avoided, and reduces the computational complexity.

Implementation of the joint structure is then straightforward. It is shown that the residual of the enhanced speech signal can be obtained by Eq. 9. The enhanced speech signal can therefore be reconstructed by IIR filtering the residual with the linear predictive model $\alpha_n$ of the clean signal.

For quantization of the residual, Eq. 4 can be modified by replacing the clean signal $s_k'$ with the estimated signal $\tilde{s}_k'$ to obtain $$\min_{r_k} \| W(\tilde{s}_k' - \tilde{s}_k') \|^2 = \min_{r_k} \| WH(r_k - \tilde{r}_k) \|^2. \tag{11}$$

In other words, the objective function with the enhanced target signal $\tilde{s}_k'$ remains the same as if having access to the clean input signal $s_k'$.

In conclusion, the only modification to standard CELP is to replace the analysis filter a of the clean signal with that of the noisy signal a'. The remaining parts of the CELP algorithm remains unchanged. The proposed approach is illustrated in FIG. 2(*c*).

It is clear that the proposed method can be applied in any CELP codecs with minimal changes whenever noise attenuation is desired and when having access to an estimate of the autocorrelation of the clean speech signal $R_{ss}$. If an estimate of the clean speech signal autocorrelation is not available, it can be estimated using an estimate of the autocorrelation of the noise signal $R_{vv}$, by $R_{ss} \approx R_{yy} - R_{vv}$ or other common estimates.

The method can be readily extended to scenarios such as multi-channel algorithms with beamforming, as long as an estimate of the clean signal is obtainable using time-domain filters.

The advantage in computational complexity of the proposed method can be characterized as follows. Note that in the conventional approach it is needed to determine the matrix-filter H, given by Eq. 8. The matrix inversion which may be used is of complexity $\mathcal{O}(M^3)$. However, in the proposed approach only Eq. 3 is to be solved for the noisy signal, which can be implemented with the Levinson-Durbin algorithm (or similar) with complexity $\mathcal{O}(N^2)$.

Code Excited Linear Prediction

In other words with respect to FIG. 3A-C, speech codecs based on the CELP paradigm utilize a speech production model that assumes that the correlation, and therefore the spectral envelope of the input speech signal $s_n$ can be modeled by a linear prediction filter with coefficients $a=[\alpha_0, \alpha_1, \ldots, \alpha_M]^T$ where M is the model order, determined by the underlying tube model [16]. The residual $r_n = a_n * s_n$, the part of the speech signal that cannot be predicted by the linear prediction filter (also referred to as predictor 18), is then quantized using vector quantization.

The linear predictive filter $a_s$ for one frame of the input signal s can be obtained, minimizing $$\min_{a_s} \varepsilon\{\|s^* a_s\|^2 - 2\sigma_s^2(u^* a_s - 1)\}, \tag{12}$$

where $u=[1\ 0\ 0\ \ldots\ 0]^T$. The solution follows as:

$$a_s = \sigma_e^2 R_{ss}^{-1} u. \tag{13}$$

With the definition of the convolution matrix $A_s$, consisting of the filter coefficients $\alpha$ of $a_s$ $$A_s = \begin{bmatrix} 1 & 0 & \ldots & & 0 \\ \alpha_1 & \ddots & & & \vdots \\ \alpha_2 & \ddots & 1 & \ddots & \\ \vdots & \ddots & \alpha_1 & 1 & 0 \\ \alpha_M & \ldots & \alpha_2 & \alpha_1 & 1 \end{bmatrix}, \tag{14}$$

the residual signal can be obtained by multiplying the input speech frame with the convolution matrix $A_s$ $$e_s = A_s \cdot s. \tag{15}$$

Windowing is here performed as in CELP-codecs by subtracting the zero-input response from the input signal and reintroducing it in the resynthesis [15].

The multiplication in Equation 15 is identical to the convolution of the input signal with the prediction filter, and therefore corresponds to FIR filtering. The original signal can be reconstructed from the residual, by a multiplication with the reconstruction filter $H_s$ $$s = H_s \cdot e_s. \tag{16}$$

where $H_s$, consists of the impulse response $\eta=[1, \eta_1 \ldots \eta_{N-1}]$ of the prediction filter $$H_s = \begin{bmatrix} 1 & 0 & \ldots & 0 \\ \eta_1 & 1 & \ddots & \vdots \\ \vdots & \ddots & \ddots & 0 \\ \eta_{N-1} & \ldots & \eta_1 & 1 \\ \vdots & & \vdots & \vdots \end{bmatrix} \tag{17}$$

such that this operation corresponds to IIR filtering.

The residual vector is quantized applying vector quantization. Therefore, the quantized vector $\hat{e}_s$ is chosen, minimizing the perceptual distance, in the norm−2 sense, to the desired reconstructed clean signal:

$$\min_{\hat{e}_s} \| WH(\hat{e}_s - e_s) \|^2, \tag{18}$$

where $e_s$ is the unquantized residual and W(z)=A (0.92z) is the perceptual weighting filter, as used in the AMR-WB speech codec [6].

Application of Wiener Filtering in a CELP Codec

For the application of single-channel speech enhancement, assuming that the acquired microphone signal $y_n$, is an additive mixture of the desired clean speech signal $s_n$ and some undesired interference $v_n$, such that $y_n = s_n + v_n$. In the Z-domain, equivalently Y(z)=S(z)+V(z).

By applying a Wiener filter B(z) it is possible to reconstruct the speech signal S(z) from the noisy observation Y(z) by filtering, such that the estimated speech signal is $\hat{S}(z) := B(z)Y(z) \approx S(z)$. The minimum mean square solution for the Wiener filter follows as [12]

$$B(z) = \frac{|S(z)|^2}{|S(z)|^2 + |V(z)|^2}, \tag{19}$$

given the assumption that the speech and noise signals $s_n$ and $v_n$, respectively, are uncorrelated.

In a speech codec, an estimate of the power spectrum is available of the noisy signal $y_n$, in the form of the impulse response of the linear predictive model $|A_y(z)|^{-2}$. In other words, $|S(z)|^2 + |V(z)|^2 \approx \gamma |A_y(z)|^{-2}$ where $\gamma$ is a scaling coefficient. The noisy linear predictor can be calculated from the autocorrelation matrix $R_{yy}$ of the noisy signal as usual.

Furthermore, it may be estimated the power spectrum of the clean speech signal $|S(z)|^2$ or equivalently, the autocorrelation matrix $R_{ss}$ of the clean speech signal. Enhancement algorithms often assume that the noise signal is stationary, whereby the autocorrelation of the noise signal as $R_{vv}$ can be estimated from a non-speech frame of the input signal. The autocorrelation matrix of the clean speech signal $R_{ss}$ can then be estimated as $\hat{R}_{ss} = R_{yy} - R_{vv}$. Here it is advantageous to make the usual precautions to ensure that $\hat{R}_{ss}$ remains positive definite.

Using the estimated autocorrelation matrix for clean speech $\hat{R}_{ss}$, the corresponding linear predictor can be determined, which impulse response in Z-domain is $\hat{A}_s^{-1}(z)$. Thus, $|S(z)|^2 \approx |\hat{A}_s(z)|^{-2}$ and Eq. 19 can be written as $$B(z) \approx \frac{|\hat{A}_s(z)|^{-2}}{|A_y(z)|^{-2}} = \frac{|A_y(z)|^2}{|\hat{A}_s(z)|^2}. \tag{20}$$

In other words, by filtering twice with the predictors of the noisy and clean signals, in FIR and IIR mode respectively, a Wiener estimate of the clean signal can be obtained.

The convolution matrices may be denoted corresponding to FIR filtering with predictors $\hat{A}_s(z)$ and $A_y(z)$ by $A_s$ and $A_y$, respectively. Similarly, let $H_s$ and $H_y$ be the respective convolution matrices corresponding to predictive filtering (IIR). Using these matrices, conventional CELP coding can be illustrated with a flow diagram as in FIG. 3B. Here, it is possible to filter the input signal $s_n$ with $A_s$ to obtain the residual, quantize it and reconstruct the quantized signal by filtering with $H_s$.

The conventional approach to combining enhancement with coding is illustrated in FIG. 3A, where Wiener filtering is applied as a pre-processing block before coding.

Finally, in the proposed approach Wiener filtering is combined with CELP type speech codecs. Comparing the cascaded approach from FIG. 3*a* to the joint approach, illustrated in FIG. 3B, it is evident that the additional overlap add windowing (OLA) windowing scheme can be omitted. Moreover, the input filter $A_s$ at the encoder cancels out with $H_s$. Therefore, as shown in FIG. 3C, the estimated clean residual signal $\tilde{e}=A_y^2H_sy$ follows by filtering the deteriorated input signal y with the filter combination $A_y^2H_s$. Therefore, the error minimization follows:

$$\min_{\tilde{e}} \| WH_s(\hat{e} - \tilde{e}) \|^2 . \tag{21}$$

Thus, this approach jointly minimizes the distance between the clean estimate and the quantized signal, whereby a joint minimization of the interference and the quantization noise in the perceptual domain is feasible.

The performance of the joint speech coding and enhancement approach was evaluated using both objective and subjective measures. In order to isolate the performance of the new method, a simplified CELP codec is used, where only the residual signal was quantized, but the delay and gain of the long term prediction (LTP), the linear predictive coding (LPC) and the gain factors were not quantized. The residual was quantized using a pair-wise iterative method, where two pulses are added consecutively by trying them on every position, as described in [17]. Moreover, to avoid any influence of estimation algorithms, the correlation matrix of the clean speech signal $R_{ss}$ was assumed to be known in all simulated scenarios. With the assumption that the speech and the noise signal are uncorrelated, it holds that $R_{ss}=R_{yy}-R_{vv}$. In any practical application the noise correlation matrix $R_{vv}$ or alternatively the clean speech correlation matrix $R_{ss}$ has to be estimated from the acquired microphone signal. A common approach is to estimate the noise correlation matrix in speech brakes, assuming that the interference is stationary.

The evaluated scenario consisted of a mixture of the desired clean speech signal and additive interference. Two types of interferences have been considered: stationary white noise and a segment of a recording of car noise from the Civilisation Soundscapes Library [18]. Vector quantization of the residual was performed with a bitrate of 2.8 kbit/s and 7.2 kbit/s, corresponding to an overall bitrate of 7.2 kbit/s and 13.2 kbit/s respectively for an AMR-WB codec [6]. A sampling-rate of 12.8 kHz was used for all simulations.

The enhanced and coded signals were evaluated using both objective and subjective measures, therefore a listening test was conducted and a perceptual magnitude signal-to-noise ratio (SNR) was calculated, as defined in Equation 23 and Equation 22. This perceptual magnitude SNR was used as the joint enhancement process has no influence on the phase of the filters, as both the synthesis and the reconstruction filters are bound to the constraint of minimum phase filters, as per design of prediction filters.

With the definition of the Fourier transform as operator $\mathcal{F}(\cdot)$, the absolute spectral values of the reconstructed clean reference and the estimated clean signal in the perceptual domain follow as:

$$S=|\mathcal{F}(WH_se_k)| \text{ and } \hat{S}=|\mathcal{F}(WH_s\hat{e}_k)|. \tag{22}$$

The definition of the modified perceptual signal to noise ratio (PSNR) follows as:

$$PSNR_{\text{ABS}} = 10 \log_{10} \frac{\| S \|^2}{\| \hat{S} - S \|^2}. \tag{23}$$

For the subjective evaluation, speech items were used from the test set used for the standardization of USAC [8], corrupted by white- and car-noise, as described above. It was conducted a Multiple Stimuli with Hidden Reference and Anchor (MUSHRA) [19] listening test with 14 participants, using STAX electrostatic headphones in a soundproof environment. The results of the listening test are illustrated in FIG. 6 and the differential MUSHRA scores in FIG. 7A-B, showing the mean and 95% confidence intervals.

Figure 6:
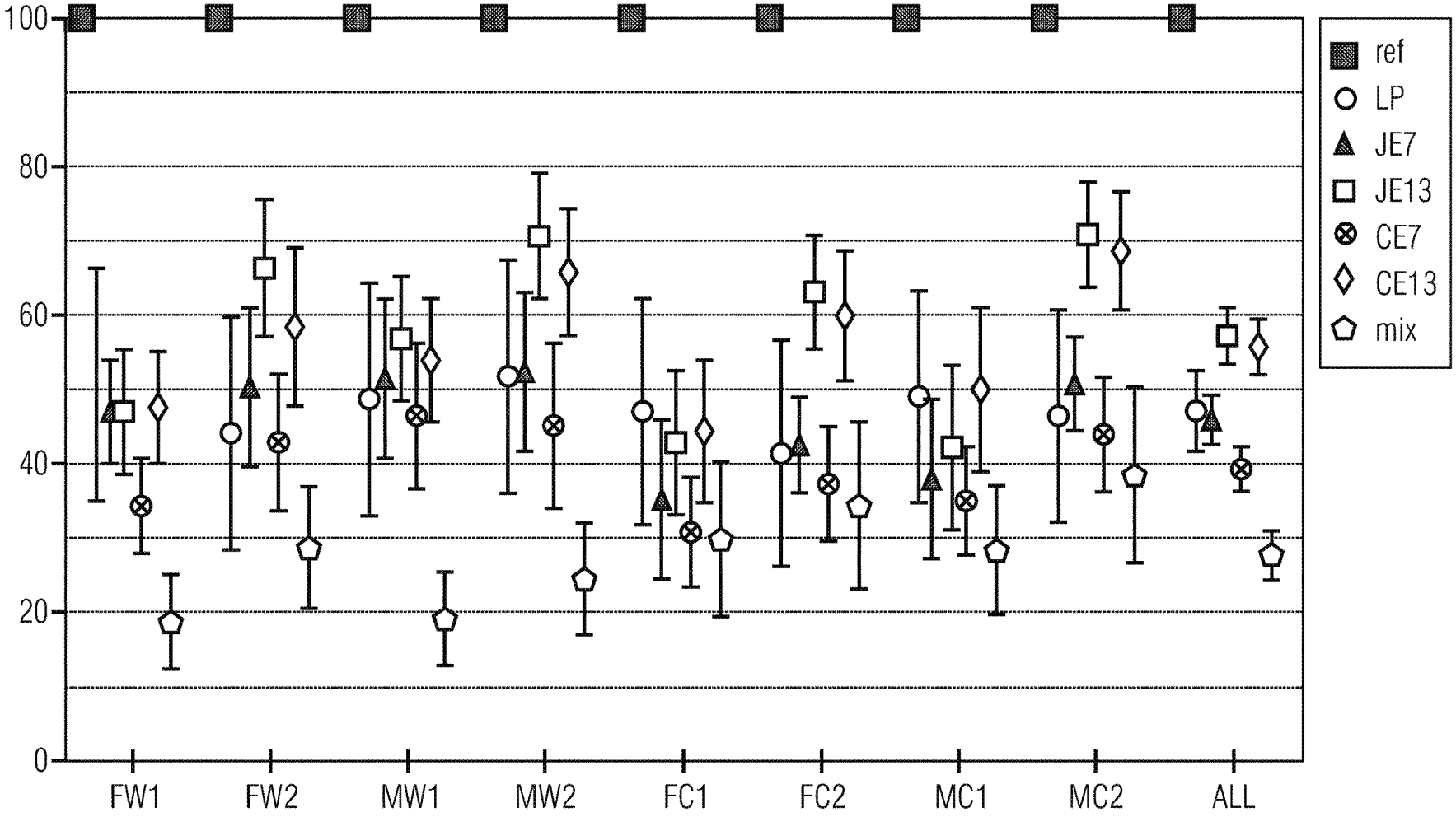
FIG. 6 shows a schematic plot showing an illustration of the MUSHRA scores for the different English speakers (female (F) and male (M)) for two different interferences (white noise (W) and car noise (C)), for two different input SNRs (10 dB (1) and 20 dB (2)), wherein all items were encoded at two bitrates (7.2 kbit/s (7) and 13.2 kbit/s (13)), for the proposed joint approach (JE) and the cascaded enhancement (CE), wherein REF was the hidden reference, LP the 3.5 kHz lowpass anchor, and Mix the distorted mixture.

The absolute MUSHRA test results in FIG. 6 show that the hidden reference was correctly assigned to 100 points. The original noisy mixture received the lowest mean score for every item, indicating that all enhancement methods improved the perceptual quality. The mean scores for the lower bitrate show a statistically significant improvement of 6.4 MUSHRA points for the average over all items in comparison to the cascaded approach. For the higher bitrate, the average over all items shows an improvement, which however is not statistically significant.

Figure 7A:
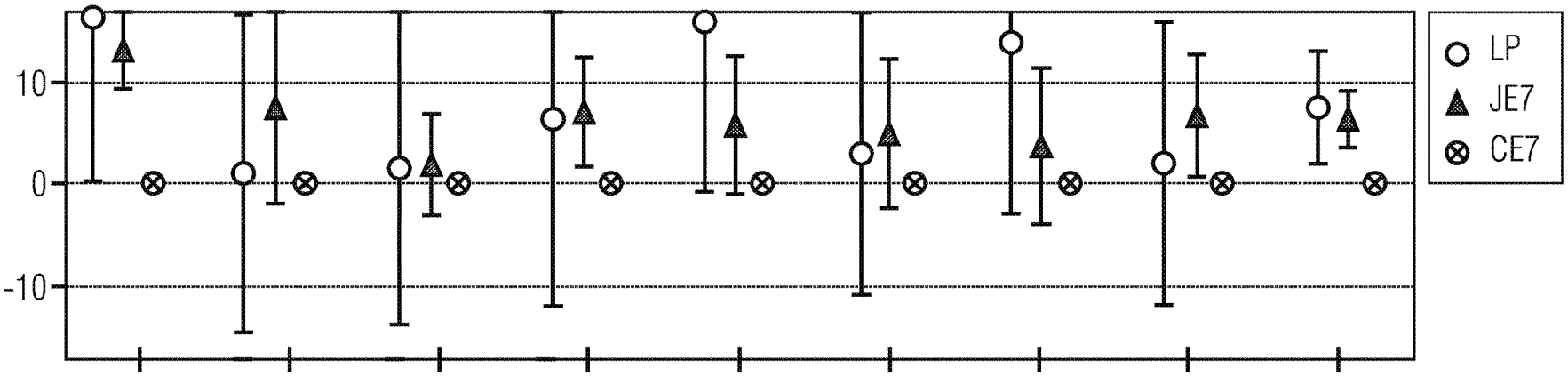
FIG. 7A shows a plot of different MUSHRA scores, simulated over two different bitrates, comparing the new joint enhancement (JE) to a cascaded approach (CE)
Figure 7B:
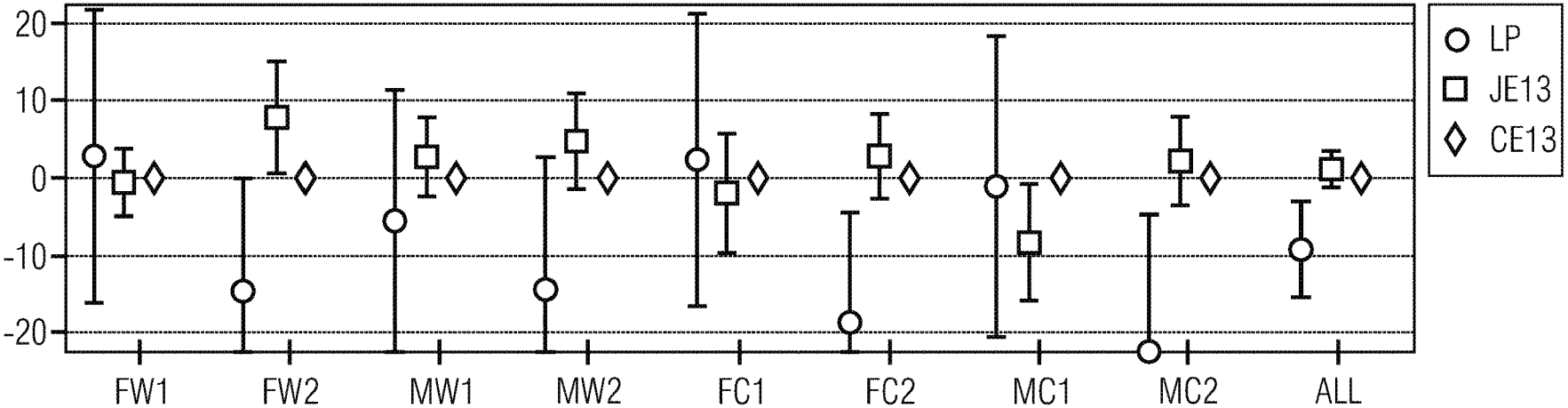
FIG. 7B shows a plot of different MUSHRA scores, simulated over two different bitrates, comparing the new joint enhancement (JE) to a cascaded approach (CE)

To obtain a more detailed comparison of the joint and the pre-enhanced methods, the differential MUSHRA scores are presented in FIG. 7A-B, where the difference between the pre-enhanced and the joint methods is calculated for each listener and item. The differential results verify the absolute MUSHRA scores, by showing a statistically significant improvement for the lower bitrate, whereas the improvement for the higher bitrate is not statistically significant.

In other words, a method for joint speech enhancement and coding is shown, which allows minimization of overall interference and quantization noise. In contrast, conventional approaches apply enhancement and coding in cascaded processing steps. Joining both processing steps is also attractive in terms of computational complexity, since repeated windowing and filtering operations can be omitted.

CELP type speech codecs are designed to offer a very low delay and therefore avoid an overlap of processing windows to future processing windows. In contrast, conventional enhancement methods, applied in the frequency domain rely on overlap-add windowing, which introduces an additional delay corresponding to the overlap length. The joint approach does not require overlap-add windowing, but uses the windowing scheme as applied in speech codecs [15], whereby avoiding the increase in algorithmic delay.

A known issue with the proposed method is that, in difference to conventional spectral Wiener filtering where the signal phase is left intact, the proposed method applies time-domain filters, which do modify the phase. Such phase-modifications can be readily treated by application of suitable all-pass filters. However, since having not noticed any perceptual degradation attributed to phase-modifications, such all-pass filters were omitted to keep computational complexity low. Note, however, that in the objective evaluation, perceptual magnitude SNR was measured, to allow fair comparison of methods. This objective measure shows that the proposed method is on average three dB better than cascaded processing.

The performance advantage of the proposed method was further confirmed by the results of a MUSHRA listening test, which show an average improvement of 6.4 points. These results demonstrate that application of joint enhancement and coding is beneficial for the overall system in terms of both quality and computational complexity, while maintaining the low algorithmic delay of CELP speech codecs.

Figure 8:
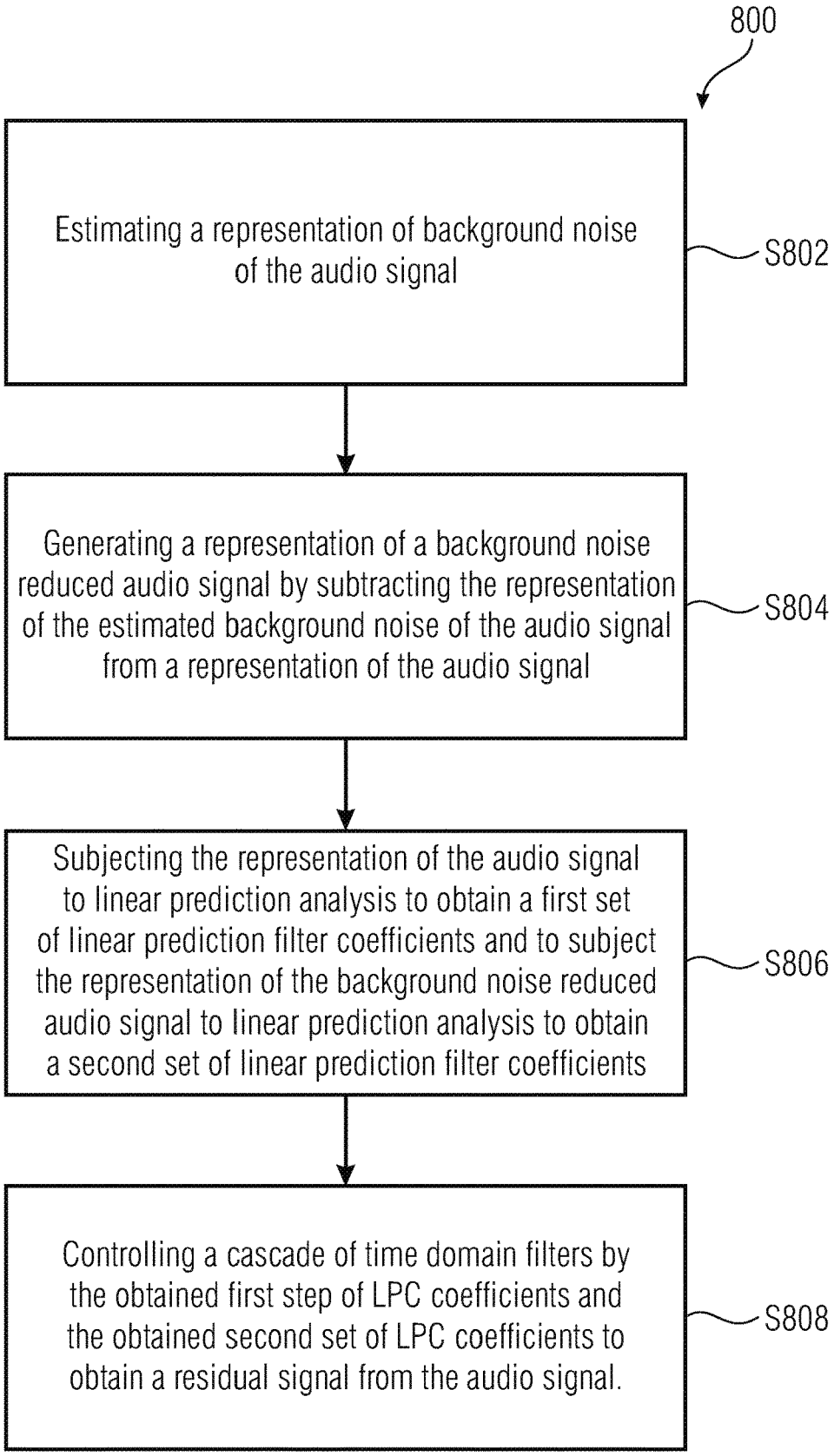
FIG. 8 shows a schematic flowchart of a method for encoding an audio signal with reduced background noise using linear predictive coding.

FIG. 8 shows a schematic block diagram of a method 800 for encoding an audio signal with reduced background noise using linear predictive coding. The method 800 comprises a step S802 of estimating a representation of background noise of the audio signal, a step S804 of generating a representation of a background noise reduced audio signal by subtracting the representation of the estimated background noise of the audio signal from a representation of the audio signal, a step S806 of subjecting the representation of the audio signal to linear prediction analysis to obtain a first set of linear prediction filter coefficients and to subject the representation of the background noise reduced audio signal to linear prediction analysis to obtain a second set of linear prediction filter coefficients, and a step S808 of controlling a cascade of time domain filters by the obtained first step of LPC coefficients and the obtained second set of LPC coefficients to obtain a residual signal from the audio signal.

It is to be understood that in this specification, the signals on lines are sometimes named by the reference numerals for the lines or are sometimes indicated by the reference numerals themselves, which have been attributed to the lines. Therefore, the notation is such that a line having a certain signal is indicating the signal itself. A line can be a physical line in a hardwired implementation. In a computerized implementation, however, a physical line does not exist, but the signal represented by the line is transmitted from one calculation module to the other calculation module.

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

The inventive transmitted or encoded signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disc, a DVD, a Blu-Ray, a CD, a ROM, a PROM, and EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may, for example, be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is, therefore, a data carrier (or a non-transitory storage medium such as a digital storage medium, or a computer-readable medium) comprising, recorded thereon, the computer program for performing one of the methods described herein. The data carrier, the digital storage medium or the recorded medium are typically tangible and/or non-transitory.

A further embodiment of the invention method is, therefore, a data stream or a sequence of signals representing the computer program for performing one of the methods described herein. The data stream or the sequence of signals may, for example, be configured to be transferred via a data communication connection, for example, via the internet.

A further embodiment comprises a processing means, for example, a computer or a programmable logic device, configured to, or adapted to, perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example, a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. Encoder for encoding an audio signal with reduced background noise using linear predictive coding, the encoder comprising:

a background noise estimator configured to estimate a representation of background noise of the audio signal;

a background noise reducer configured to generate a representation of a background noise reduced audio signal by subtracting the estimated representation of the background noise of the audio signal from a representation of the audio signal;

a predictor configured to subject the representation of the audio signal to linear prediction analysis to acquire a first set of linear prediction filter (LPC) coefficients and to subject the representation of the background noise reduced audio signal to linear prediction analysis to acquire a second set of linear prediction filter (LPC) coefficients; and an analysis filter composed of a cascade of time-domain filters controlled by the acquired first set of LPC coefficients and the acquired second set of LPC coefficients to acquire a residual signal from the audio signal;

wherein the encoder is implemented using a hardware apparatus, or using a computer, or using a combination of a hardware apparatus and a computer.

2. Encoder according to claim 1, wherein the cascade of time domain filters comprises a first linear prediction filter and a second linear prediction filter which use the acquired first set of LPC coefficients followed by an inverse of a third linear prediction filter which uses the acquired second set of LPC coefficients.

3. Encoder according to claim 1, wherein the cascade of time-domain filters is a Wiener filter.

4. Encoder according to claim 1, wherein the background noise estimator is configured to estimate an autocorrelation of the background noise as the estimated representation of the background noise;

wherein the background noise reducer is configured to generate the representation of the background noise reduced audio signal by subtracting the autocorrelation of the background noise from an autocorrelation of the audio signal, wherein the autocorrelation of the audio signal is the representation of the audio signal and wherein the representation of the background noise reduced audio signal is an autocorrelation of a background noise reduced audio signal.

5. Encoder according to claim 1, wherein the estimated representation of the background noise of the audio signal is an autocorrelation of the background noise of the audio signal and the representation of the audio signal is an autocorrelation of the audio signal.

6. Encoder according to claim 1, further comprising a transmitter configured to transmit the second set of LPC coefficients.

7. Encoder according to claim 1, further comprising a transmitter configured to transmit the residual signal.

8. Encoder according to claim 1, further comprising a quantizer configured to quantize and/or encode the residual signal before transmission.

9. Encoder according to claim 8, wherein the quantizer is configured to use code-excited linear prediction (CELP), entropy coding, or transform coded excitation (TCX).

10. Encoder according to claim 1, further comprising a quantizer configured to quantize and/or encode the second set of LPC coefficients before transmission.

11. System comprising:

an encoder for encoding an audio signal with reduced background noise using linear predictive coding, said encoder comprising:

a background noise estimator configured to estimate a representation of background noise of the audio signal;

a background noise reducer configured to generate a representation of a background noise reduced audio signal by subtracting the estimated representation of the background noise of the audio signal from a representation of the audio signal;

a predictor configured to subject the representation of the audio signal to linear prediction analysis to acquire a first set of linear prediction filter (LPC) coefficients and to subject the representation of the background noise reduced audio signal to linear prediction analysis to acquire a second set of linear prediction filter (LPC) coefficients; and an analysis filter composed of a cascade of time-domain filters controlled by the acquired first set of LPC coefficients and the acquired second set of LPC coefficients to acquire a residual signal from the audio signal;

a decoder configured to decode the encoded audio signal, wherein each of the encoder and the decoder is implemented using a hardware apparatus, or using a computer, or using a combination of a hardware apparatus and a computer.

12. Method for encoding an audio signal with reduced background noise using linear predictive coding, the method comprising:

estimating a representation of background noise of the audio signal;

generating a representation of a background noise reduced audio signal by subtracting the estimated representation of the background noise of the audio signal from a representation of the audio signal;

subjecting the representation of the audio signal to linear prediction analysis to acquire a first set of linear prediction filter (LPC) coefficients and subjecting the representation of the background noise reduced audio signal to linear prediction analysis to acquire a second set of linear prediction filter (LPC) coefficients; and controlling a cascade of time domain filters by the acquired first set of LPC coefficients and the acquired second set of LPC coefficients to acquire a residual signal from the audio signal.

13. Non-transitory digital storage medium having a computer program stored thereon to perform a method for encoding an audio signal with reduced background noise using linear predictive coding, said method comprising:

estimating a representation of background noise of the audio signal;

generating a representation of a background noise reduced audio signal by subtracting the estimated representation of the background noise of the audio signal from a representation of the audio signal;

subjecting the representation of the audio signal to linear prediction analysis to acquire a first set of linear prediction filter (LPC) coefficients and subjecting the representation of the background noise reduced audio signal to linear prediction analysis to acquire a second set of linear prediction filter (LPC) coefficients; and controlling a cascade of time domain filters by the acquired first set of LPC coefficients and the acquired second set of LPC coefficients to acquire a residual signal from the audio signal, when said computer program is run by a computer.

* * * * *